US005193620A

United States Patent [19]

Braddick

[11] Patent Number: 5,193,620

[45] Date of Patent: Mar. 16, 1993

[54] WHIPSTOCK SETTING METHOD AND APPARATUS

[75] Inventor: Britt O. Braddick, Houston, Tex.

[73] Assignee: TIW Corporation, Houston, Tex.

[21] Appl. No.: 740,458

[22] Filed: Aug. 5, 1991

[51] Int. Cl.[5] ..... E21B 7/08; E21B 23/06; E21B 23/00

[52] U.S. Cl. ..... 166/382; 166/117.6; 175/81; 175/82

[58] Field of Search ..... 166/117.5, 117.6, 138, 166/140, 382; 175/79, 81, 82

[56] References Cited

U.S. PATENT DOCUMENTS

| | | | |
|---|---|---|---|
| 2,020,471 | 11/1935 | Layne | 166/117.6 X |
| 3,115,935 | 12/1963 | Hooton | 166/117.6 |
| 4,285,399 | 8/1981 | Holland et al. | 166/117.6 X |
| 4,397,355 | 8/1983 | McLamore | 166/117.6 X |

*Primary Examiner*—Stephen J. Novosad
*Attorney, Agent, or Firm*—Jack W. Hayden

[57] ABSTRACT

A whipstock setting apparatus includes a whipstock with a mandrel secured thereto and depending therefrom. A cutter, or mill is connected to a work string and releasably connected to the whipstock. A packer assembly including a mechanical weight set packer and upper and lower cone and slip means are mounted on the mandrel above and below the packer. The mandrel is releasably connected to the packer assembly to prevent premature longitudinal movement therebetween and to accommodate relative longitudinal movement therebetween when desired. The components of the whipstock assembly and packer assembly are secured so as to maintain alignment with the face of the whipstock while lowering the whipstock in the well tubular member, after the mandrel is released for longitudinal movement relative to the packer assembly and after the whipstock is oriented in the well tubular member whereby the oriented whipstock and packer assembly are anchored in the well tubular member by longitudinal movement of the work string to minimize or eliminate changing the orientation of the whipstock.

30 Claims, 3 Drawing Sheets

WHIPSTOCK SETTING METHOD AND APPARATUS

STATEMENT OF THE PRIOR ART

It is well known to use whipstocks in drilling to direct or deviate a drill bit or cutter at an angle from a well bore. In earlier practice it was customary to initially set a cement plug, a packer and a whipstock at the desired elevation in a well tubular member such as a casing. The orienting of the whipstock was then accomplished in a well known manner and required a multiple trip operation into and out of the well bore.

More recently, U.S. Pat. No. 4,397,355 issued disclosing a single trip procedure and apparatus for orienting and anchoring a whipstock in a well bore; however, this procedure involves the use of hydraulics along with a hydraulically inflatable packer and a special valving arrangement to close off flow to the drill bit and direct it to inflate the packer after the whipstock has been oriented and thereafter redirecting the fluid to the drill bit in a desired manner for conducting drilling operations.

It is not always desirable to use a hydraulic arrangement, and it can be appreciated that problems may arise in connection with the valving arrangement employed or in undesired rotation of the whipstock after orientation and before setting the packer hydraulically.

SUMMARY OF THE INVENTION

An object of the present invention is to provide an arrangement and method for lowering a whipstock with a packer into a well bore on a well string and the well string manipulated to enable the whipstock to be oriented and then manipulating the work string to weight set the packer to anchor the oriented whipstock.

A further object of the invention is to accomplish the foregoing without moving the whipstock from its oriented position while setting the packer to anchor the whipstock.

Yet another object of the present invention is to releasably secure a whipstock and packer assembly to a mill connected on a well, or work string, for lowering into a well tubular member, such as a casing, so that the work string can be manipulated to orient the whipstock in a desired direction in the cased well bore by means well known in the art, then set the packer to anchor the whipstock in the oriented position in the cased well bore, release the mill and work string from the whipstock, and mill a window in the casing.

Yet a further object of the present invention is to provide a single trip method and apparatus for orienting and anchoring a whipstock in a well tubular member by manipulation of the well string.

Yet a further object of the present invention is to provide a single trip method and apparatus for orienting and anchoring a whipstock in a well tubular member by manipulation of a well string wherein means are provided to prevent premature actuation of the mechanical weight set packer until the whipstock has been oriented in the well tubular member.

Still another object of the present invention is to provide an arrangement to prevent relative longitudinal movement between a whipstock assembly and a packer assembly supported on the whipstock assembly to avoid premature setting of the packer whereby the whipstock and packer assemblies may be lowered together into a well tubular member and the whipstock assembly oriented to face in the desired manner within the cased well bore. Thereafter the work string is lowered to mechanically set the packer assembly and anchor the whipstock within the cased well bore to maintain it in its oriented position.

Other objects and advantages of the present invention will become more readily apparent from a consideration of the following drawings and description.

DESCRIPTION OF THE PREFERRED EMBODIMENTS

The present invention will be described in detail in what is termed a single trip operation in which the whipstock and packer are releasably secured to a mill connected to a well string which is then lowered to the desired level in the cased well bore. The well string is then manipulated and the whipstock oriented in a manner well known in the art to face in a desired direction and the well string then manipulated to set the packer for anchoring the whipstock in the oriented position in the cased well bore. The work string is then lowered and rotated to cut a window in the cased well bore for drilling the well bore in a deviated direction. However, it can be appreciated that the mill may be omitted and the present invention may be employed to anchor a packer in the cased well bore and multitrip operations carried out in a manner well known in the prior art.

Figure 1:
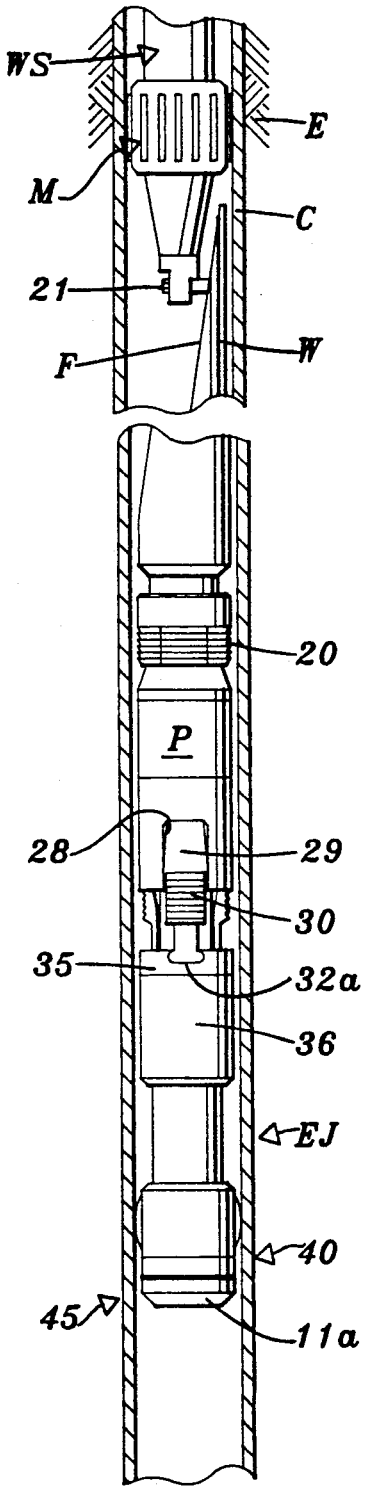
FIG. 1 is a sectional view partly in elevation illustrating the preferred embodiment of the present invention lowered into a well tubular member with the packer in retracted, or unexpanded position.
Figure 2:
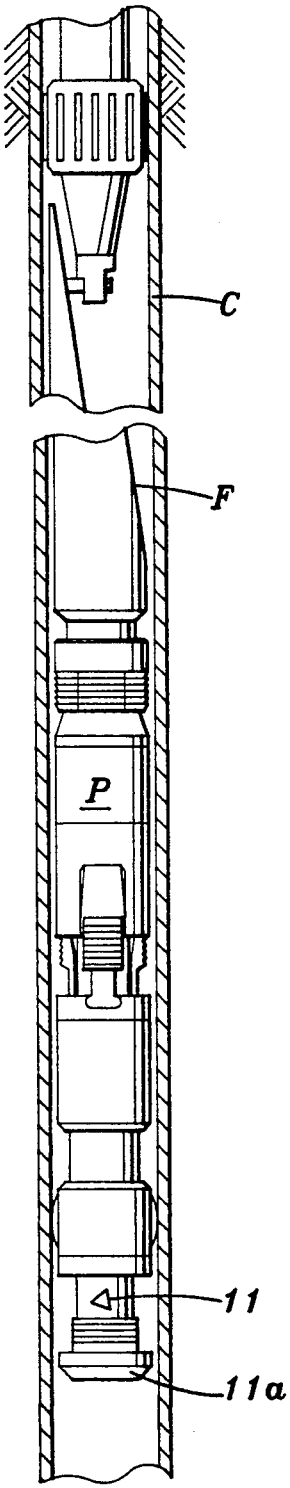
FIG. 2 is a view similar to FIG. 1 and illustrates the mandrel in position for longitudinal movement to anchor the whipstock after it is oriented in the well tubular member to the desired oriented position.

Attention is first directed to FIG. 1 of the drawings wherein a casing, or well tubular member, is represented by the letter C and is shown as extending into the earth represented at E.

Figure 3:
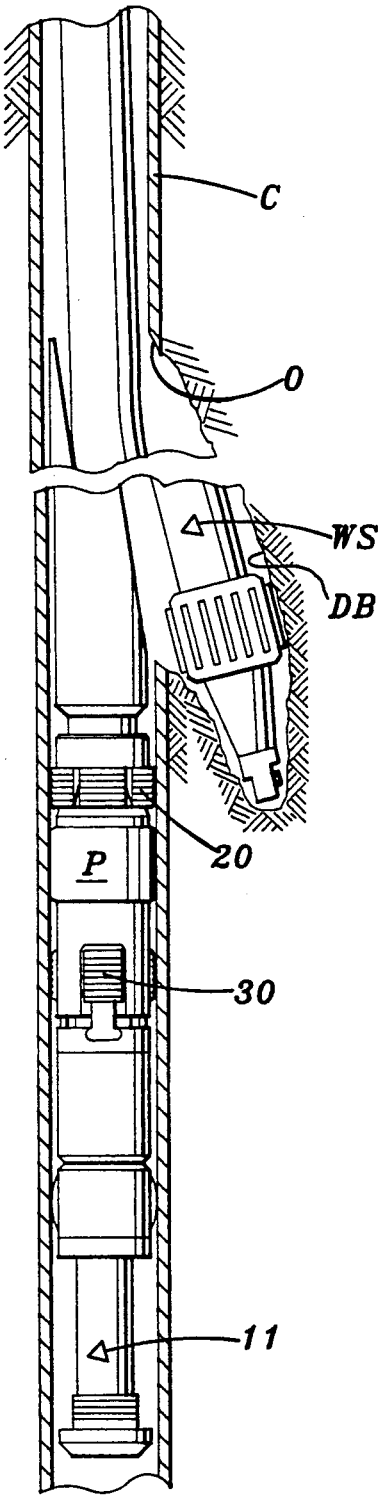
FIG. 3 is a view similar to FIGS. 1 and 2 and illustrates the packer expanded by manipulating the well string to anchor the whipstock in oriented position within the well tubular member for enabling the work string to be manipulated to disengage from the whipstock and then mill a window in the well tubular member, such as the casing, and start drilling the deviated well bore.

A work string represented generally by the letters WS is shown as extending from the earth's surface into the well tubular member C and includes a mill or cutter thereon represented generally by the letter M. While only one mill is shown, additional mills or cutters may be provided on the work string in a manner well known in the art to accomplish whatever results are desired. The mill M is shown as being releasably secured by suitable means well known in the art such as a shear pin 21 adjacent the upper end of a whipstock W. The upper end of the whipstock includes a longitudinally extending inclined, concave face F which when oriented and anchored in the casing C as shown in FIG. 3 enables the work string to be guided in a desired manner and rotated to cut a window or opening 0 in the casing and move therethrough to drill a deviated well bore DB as represented in the drawings.

Figure 4:
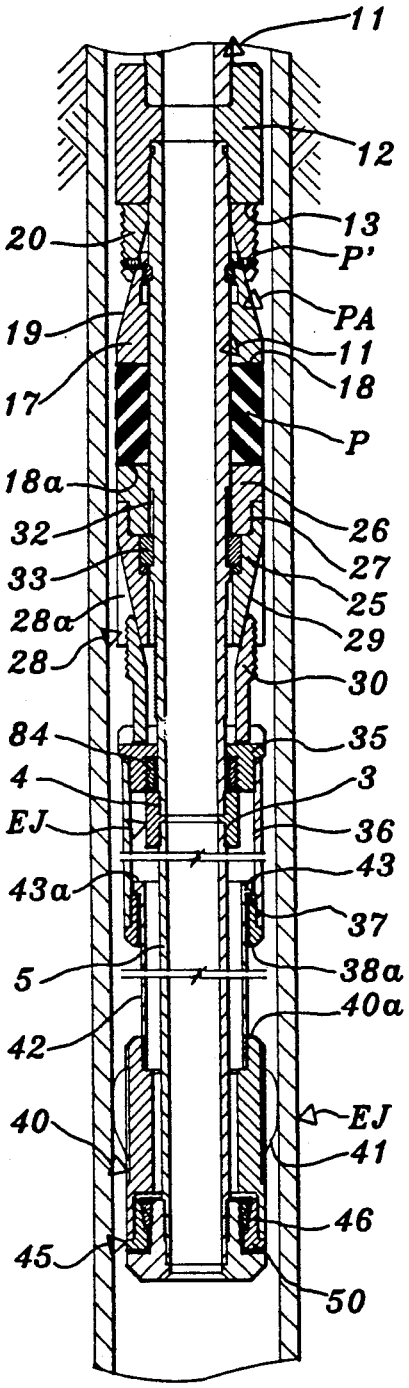
FIG. 4 is a sectional view illustrating the packer assembly supported on the mandrel which is connected with the whipstock and depends therefrom.
Figure 5:
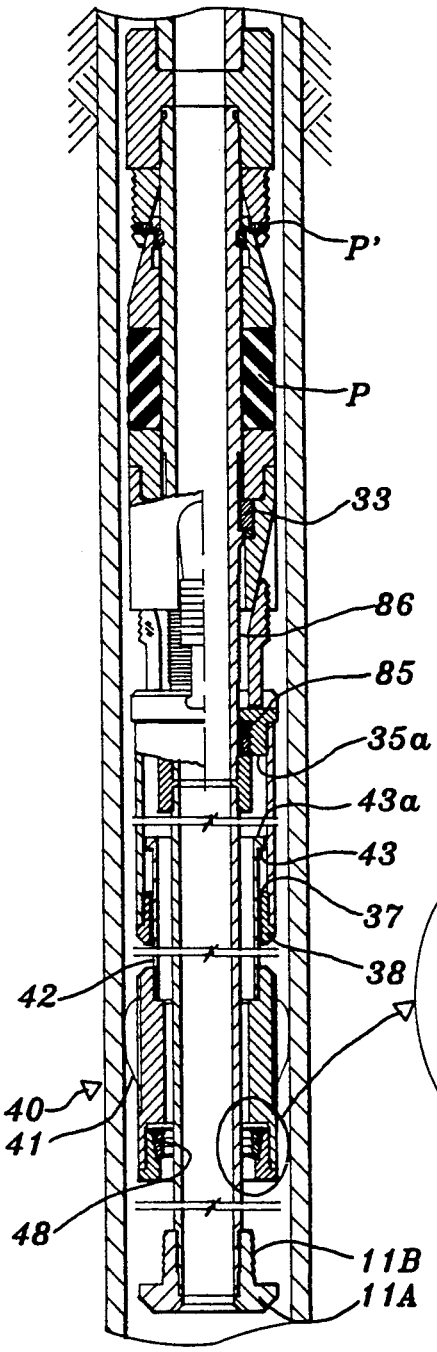
FIG. 5 is a sectional view showing in greater detail the position of the mandrel relative to the packer assembly after the work string has been manipulated or rotated to release the mandrel for longitudinal movement to anchor the packer assembly and whipstock within the well tubular member after the whipstock is oriented within the well tubular member.
Figure 10:
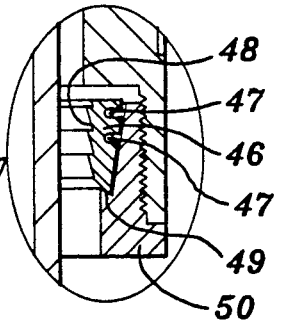
FIG. 10 is an enlarged partial sectional view illustrating details of the releasable latch means.
Figure 6:
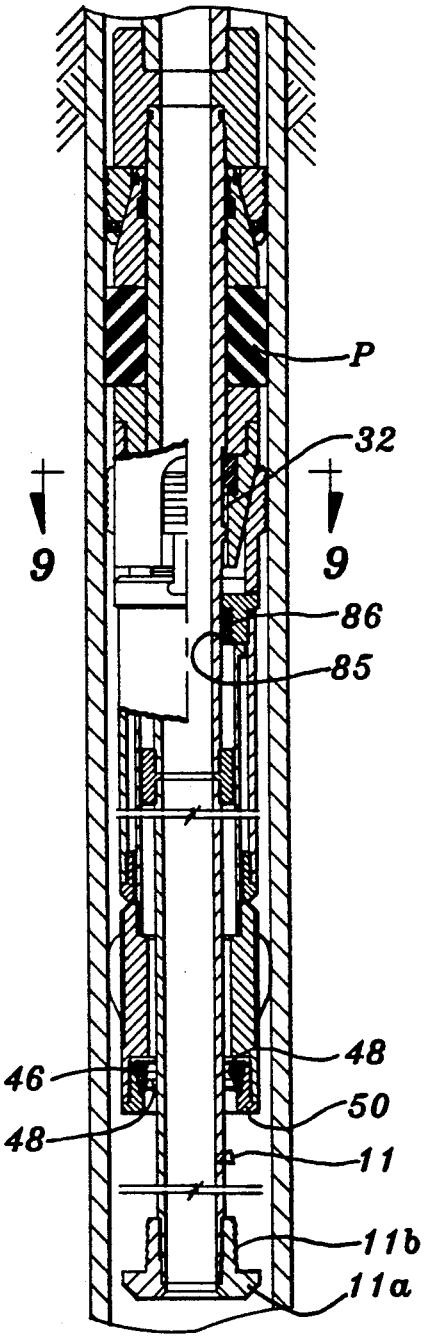
FIG. 6 illustrates the position of the mandrel relative to the packer assembly after the work string is manipulated to expand the packer to anchor the oriented whipstock in position in the well tubular member.

The whipstock assembly may be stated as including the whipstock W and the hollow mandrel 11 which is secured therewith and depends therefrom as shown in FIGS. 4–6. As shown in FIG. 4, a coupling 12 is provided on the mandrel 11 which coupling has a downwardly facing shoulder as represented at 13, and the mandrel extends longitudinally through the packer assembly referred generally by the letters PA and the expansion joint EJ. The mandrel may be considered as an extension of the whipstock.

The packer assembly PA generally includes a mechanically weight set packer P which surrounds and is mounted on the mandrel 11 as shown in the drawings, upper and lower cone means 17 and 25 and upper and lower slip means 20 and 30 above and below the packer, respectively. An expansion joint or member EJ is formed by the friction cage assembly or member 40 telescopically received in the lower end of the packer assembly, as will be described in greater detail hereinafter. The lower end of the mandrel 11 is connected adjacent the lower end of the friction member 40 by suitable releasable latch means referred to generally by the numeral 45 to prevent premature longitudinal movement of the mandrel 11 and the whipstock and packer assemblies.

Figure 9:
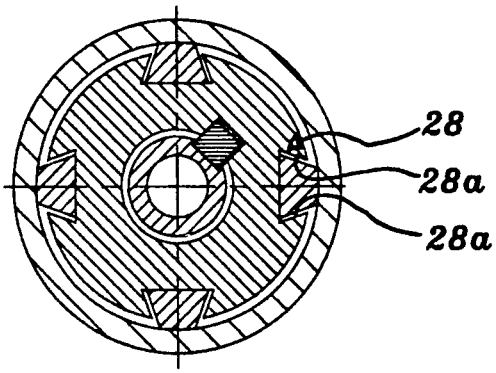
FIG. 9 is a sectional view on the line 9—9 of FIG. 6 and illustrates means to prevent relative rotation and relative longitudinal movement between the whipstock assembly and packer assembly.

The upper cone means 17 is positioned adjacent the upper end 18 of the packer P as shown, and includes an upwardly and inwardly inclined annular surface 19 as shown in the drawings. Upper slip means 20 are provided adjacent the downwardly facing shoulder 13 and are connected with the cone means 17 by the shear pins P' in a manner well known in the art. The slip means 20 are circumferentially spaced on the cone means 17 in a manner well known in the art. Lower cone means 25 are connected with the member 26 by suitable means such as the threads 27 and are positioned adjacent or abut the lower end 18*a* of the packer P. The lower cone means 25 include a plurality of dove tailed grooves 28 more clearly shown in FIG. 9 of the drawings. The dove tailed grooves 28 include a downwardly and inwardly inclined longitudinally extending bottom surface 29 for receiving the lower slips 30 thereon. As illustrated in FIG. 9, the longitudinally extending grooves 28 are circumferentially spaced about the lower cone means 25 and thus position the lower slips 30 at circumferentially spaced intervals about the lower cone means 25.

When the apparatus is assembled as illustrated in FIGS. 4 and 5 of the drawings, relative rotation between the mandrel 11 and the packer assembly is prevented by reason of the longitudinally extending slot 32 in the outer surface of the mandrel which forms a keyway to receive the key 33 within the slot 32 adjacent one end thereof as shown in FIGS. 4 and 5. The other end of the key abuts the lower end of member 26 and when the apparatus is in the assembled relationship shown in FIG. 4 relative longitudinal movement between the mandrel 11 and the whipstock and packer assemblies is prevented. The lower slips 30 include ends 32*a* that are received within and supported in conforming openings of the slip support ring member 35. The slip support ring 35 is connected with a depending skirt portion 36 secured to the ring support 35 by any suitable means such as threads or the like. The lower end of the skirt 36 is provided with a member 38 threaded internally thereof as shown to provide an annular shoulder 37 within skirt or tubular member 36.

A friction cage assembly referred to generally at 40 in FIGS. 4 and 5 includes spring members 41 which frictionally engage the interior of the well tubular member such as a casing as shown and such cage in turn includes an extension 42 extending upwardly therefrom and which is telescopically received within the skirt 36 as shown. An annular shoulder 43 on the extension 42 is provided which abuts the shoulder 37 when the friction cage assembly is in the position illustrated in FIG. 4 of the drawings. The shoulders 37 and 43 prevent separation of skirt 36 and cage 40.

The slip support ring 35, its depending portion 36 and the friction cage 40 telescopically engaged with skirt 36 form an expansion joint, as will be described.

As previously noted, the mandrel 11 depends from the whipstock, extends through the packer assembly and cage 40, and the mandrel lower end is provided with an end member 11*a* as shown.

The latch means represented generally at 45 is provided for securing the member 11*a* on mandrel 11 with the friction cage assembly 40 of the expansion member, or joint EJ as shown in FIG. 4 of the drawings. Such latch means 45 includes a split ring 46 formed by multiple annular segments which segments are surrounded by resilient means such as springs 47 or the like to form the annular ring 46. The inner annular surface of ring 46 formed by the annular segments 46 is provided with a suitable threaded surface 48, as shown, for engaging the external threads 11*b* on the lower end cap 11*a* of the mandrel to secure the mandrel 11, the whipstock and the packer assembly against longitudinal movement and to maintain the expansion joint EJ in its extended or expanded position as seen in FIG. 4 until it is desired to orient the whipstock in the well bore. This also maintains the lower slips 30 in the retracted position shown in FIG. 4 to prevent premature setting of the packer P.

The lower end of the segments 46 are conformed with the V-shaped groove on shoulder 49 formed in the coupling 50 threadedly engaged in the lower end of the friction cage assembly 40 and retain the segments 46 engaged therewith when the mandrel is disconnected from coupling 50 as seen in FIG. 5. Such structure is well known in the art.

After the whipstock assembly including the whipstock and the mandrel, and the packer assembly comprising the packer, upper and lower cone and slip means, and the expansion joint including the friction cage assembly have been lowered into position, or desired level, in the well tubular member C, it is then desirable to release the mandrel 11 so that after the work string, whipstock and packer assembly are rotated to enable the slanted whipstock face F to be properly oriented in the desired direction in which the drilling is to be continued within the well tubular member, the whipstock can be readily anchored in such oriented position with a minimum of manipulation of the well string and in a manner less likely to adversely affect the whipstock orientation.

Particularly, the present invention is constructed and arranged so that after the whipstock has been oriented in the casing C, the only movement necessary to anchor the whipstock in position in the casing C by the mechanical set packer is to lower the mandrel 11 from the position illustrated in FIG. 5 to that in FIG. 6. This arrangement greatly reduces the likelihood that the oriented position of the whipstock will be changed while it is being anchored within the casing C.

To further assure that the apparatus of the present invention can be positioned at the desired location in the well tubular member to enable the whipstock to be oriented and anchored at such location, means are provided to prevent movement of the upper cone means in an undesired manner which might cause engagement of the upper slip and cone means and premature setting of the packer assembly as it is lowered into the well tubular member, such as the casing C.

As the apparatus of the present invention is lowered into the well bore, it can be appreciated that additional lengths of pipe are added to the work string. In this operation, it is necessary to elevate the work string and then lower it as each section is added. During such up movement of the work string, it may be that the upper cone 19 might accidentally engage within the tubular member so as to apply a downward jar or force to the upper cone in the direction represented by the arrow 55 in FIG. 7. In order to prevent such action from shearing the pin P', cooperating groove means and an interfitting split ring arrangement is provided as illustrated in FIGS. 7 and 8 of the drawings which prevents the upper cone means from moving down in response to any downward jar or force thereon.

The cooperating groove means includes a first annular groove means represented generally at 60 formed on the outer surface of the mandrel having an annular bottom surface 61 as shown. A lower end surface 62 extends laterally outwardly from the annular bottom surface 60 at a right angle toward the upper cone 17 and an upper end surface 63 is inclined upwardly and outwardly from the annular bottom surface 60.

Figure 8:
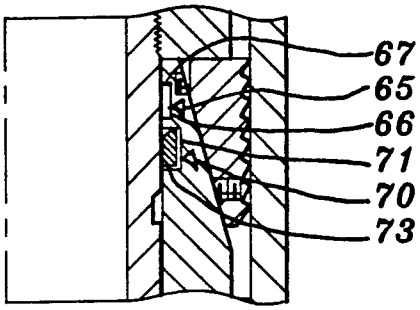
FIG. 8 is a partial sectional enlarged view similar to FIG. 7 and illustrates in greater detail the position of the mandrel and the cooperating groove means on the mandrel and upper cone means along with the split ring to enable the mandrel to be moved downwardly longitudinally as shown in FIG. 6 for setting the mechanical weight set packer.

First annular groove means 65 are provided in the upper cone means 17 and as better illustrated in FIG. 8, the first annular groove means includes an annular bottom surface 66. An upper end surface 67 extends laterally and outwardly from the annular bottom surface 65 towards the mandrel 11 as illustrated.

Figure 7:
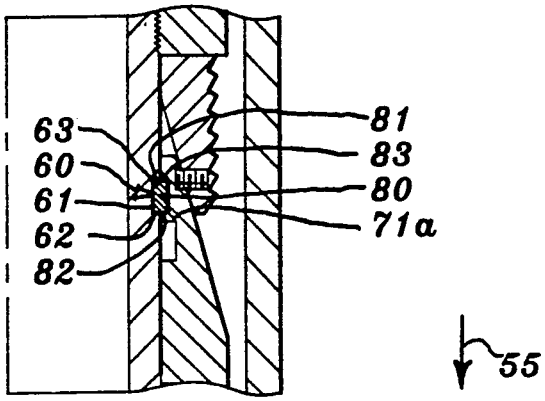
FIG. 7 is an enlarged partial view of the upper cone and slip means illustrating cooperating groove means on the mandrel and on the upper cone means for receiving interconnecting means to inhibit, or prevent premature downward movement of the upper cone means relative to the upper slip means to avoid premature setting of the packer.

Second annular groove means 70 are provided in the upper cone means 17, said second annular groove means 70 having a bottom annular surface 71 whose upper end portion is inclined upwardly and outwardly as represented at **71*a* and provides an opening which communicates with the lower open end of the first annular groove means 65 as shown in FIGS. 7 and 8**.

The second annular groove means 70 is of larger diameter than the diameter of the first annular groove 65 means as shown in FIGS. 7 and 8. The bottom end surface 73 of the second annular groove means extends laterally and outwardly as shown in the drawings.

Interfitting means such as split ring means 80 is positioned within said annular groove means 60 on the mandrel 11 and in said annular groove means 65 in the upper cone means 17 when the whipstock assembly is secured with the packer assembly PA for lowering into the well bore. The split ring means 80 includes an upper end surface 81 which is tapered upwardly to conform with the upwardly and outwardly inclined surface 63 of the annular groove means 60 on mandrel 11. Split ring means 80 includes a laterally extending lower end surface 82 which abuts the bottom end surface 62 of the annular groove means 60 on the mandrel. The split ring also includes a laterally extending upper end surface portion 83 which abuts upper laterally extending end surface 67 of the first annular groove means 65 in upper cone means 17. Thus, the engagement of the lower and upper laterally extending ends 82 and 83 of the split ring 80 with the lower laterally extending end 62 of the annular groove 60 in the mandrel 11 and the upper laterally extending end 67 of the groove 65 in the upper cone means 17, respectively, prevent downward movement of the upper cone means 17 should it strike some object as the assembly of the present invention is being single tripped into the well tubular member.

Also, by reason of the groove 32 and keyway 33 and latch 45 it can be appreciated that the lower cone and slip means 25 and 30 are locked in position against longitudinal movement relative to the mandrel 11 as the apparatus is tripped into the well bore to prevent premature engagement of the lower slip means 30 with the inclined surface 29 in the circumferentially spaced grooves 28.

Similarly, the upper slip means is locked in position against movement in a manner which might cause premature shearing of the shear pin P' thus reducing, if not eliminating, the likelihood of premature setting of the packer P as the apparatus is tripped into the well bore casing.

The foregoing locks the mandrel 11 and the lower cone means 25 together. The lower slip means 30 is keyed to the lower cone means so that all the components remain oriented with the face F of the whipstock W.

The bottom latch 45 secures the whipstock assembly and the packer assembly together as the invention is lowered into the well bore which secures all of the components in the position described to further reduce the likelihood of premature expansion of the packer into engagement with the well tubular member. The bottom latch 45 enables the mandrel to be released from the packer assembly for longitudinal movement relative to the packer assembly to set the packer after the whipstock is oriented.

In operation of the present invention, after the apparatus is lowered to the desired level in the casing C, the work string is rotated. Spring members 41 restrain rotation of the friction cage assembly 40 relative to the mandrel 11 when the work string is rotated which causes the latch means 45 to be actuated and unthreaded. The mandrel 11, whipstock and packer assembly may then be lowered to the position shown in FIG. 5 by lowering the work string. It will be noted that at such time the expansion joint EJ is partially collapsed, but the end surface 43*a* on annular shoulder 43 remains in spaced relation to the lower end 35*a* of the ring support 35 of slips 30 as shown in FIG. 4. The friction cage assembly, when in extended position, is of sufficient longitudinal extent, by way of example only, three feet between the lower end 35*a* of support 35 and end surface 43*a* to prevent premature engagement. However, the whipstock and packer assembly PA are still locked against relative rotational movement by means of the key 32 and keyway 33 so that the whipstock and work string may be rotated along with the packer assembly PA to enable the whipstock to be oriented, by means and in a manner well known in the art, to position face F in the desired direction and position within the well tubular member, or casing C.

After the whipstock has been oriented, the only thing remaining is to anchor it and this can be readily accomplished by lowering the mandrel 11 from the position shown in FIG. 5 to the position shown in FIG. 6. This lowering movement causes the friction cage assembly 40 to remain stationary while the mandrel 11 is lowered so that the end surface 43*a* on shoulder 43 and end surface 35*a* on the bottom ring 35 engage or the lower end 38*a* of the member 38 and the upper end 40*a* of the slip cage assembly 40 abut which holds slips 30 as the mandrel and cone 25 move down and this moves lower slips 30 onto the inclined surface 29 within the grooves 28 of lower cone 25 and set, or grip the inner wall of casing C which stops the downward movement of the lower cone.

Continued movement down of the work string forces the shoulder 13 of coupling 12 to push against the shear pins P' which retain the upper cone and slips engaged and in unset position until such pins break in response to down movement of the work string and mandrel . The split ring 80 moves down with mandrel 11 and shifts out of the lower open end of the first annular groove 65 in the upper cone 17 and into larger diameter groove 70. This permits ring 80 to expand from mandrel groove 60 into groove 70 as the mandrel is lowered which permits the mandrel to continue movement down as the work string is lowered. This moves the upper slips and cone down together to further compress packer P into anchoring position and then set the upper slips and cone in casing C.

As the mandrel 11 moves down, cooperating surface means on the lower slip support means which may be in the form of suitably configured threads 85 on the inner annular surface of the ratchet ring 84 supported by the slip support ring 35 engage surface means 86 which may be in the form of suitably configured threads formed on the mandrel 11 to lock the mandrel in its lowermost position when packer P has expanded into anchoring engagement with the casing and the lower slips have been engaged with the lower cone and the upper slips engaged with the upper cone to secure or anchor the packer P and whipstock in oriented position in the well tubular member C.

Since the only movement with the present apparatus or arrangement after the whipstock has been oriented in the desired direction is a longitudinal down movement, and since the components of the packer assembly remain oriented with the face F of the whipstock, the whipstock is maintained in its oriented position and anchored in such position thus reducing if not completely eliminating the likelihood that the orientation of the whipstock will change during such anchoring. It can be appreciated that the whipstock assembly and packer assembly remain in the well tubular member.

The foregoing disclosure and description of the invention are illustrative and explanatory thereof, and various changes in size, shape and materials as well as in the details of the illustrated construction may be made without departing from the spirit of the invention.

What is claimed is:

1. A whipstock assembly and packer assembly for lowering together in a well bore on a work string for orienting and anchoring the whipstock assembly and packer assembly in a cased well bore in a single trip by manipulating the work string, comprising:

a whipstock assembly, said assembly including:

a whipstock for releasably connecting with the work string;

a mandrel secured to said whipstock and depending therefrom;

a packer assembly supported on said mandrel;

said packer assembly including a mechanical weight compression set packer; and upper and lower slip and cone means above and below, respectively, said packer.

2. The apparatus of claim 1 including means to prevent premature setting of said packer by said upper and/or lower slip and cone means while positioning and orienting said whipstock in the cased well bore.

3. The apparatus of claim 2 wherein said means to prevent premature setting of said packer by said upper and/or lower slip and cone means includes means to prevent downward movement of said upper cone means relative to said upper slip means and means to prevent downward movement of said lower cone means relative to said lower slip means.

4. The apparatus of claim 2 wherein said means to prevent downward movement of said upper cone means relative to said upper slip means includes cooperating recess means on said mandrel and said upper cone means with interfitting means extending between said cooperating recess means on said mandrel and said upper cone means.

5. The apparatus of claim 3 wherein said means to prevent premature setting of said packer by said upper and lower slip and cone means further includes releasable latch means to releasably secure said mandrel and packer assembly against relative longitudinal movement.

6. The apparatus of claim 1 including means to inhibit relative rotation between said lower slip and cone means and means to inhibit relative rotation between said lower cone means and said mandrel.

7. The apparatus of claim 1 including co-engageable locking means on said mandrel and packer assembly to secure said whipstock assembly and said packer assembly in oriented and anchored position in the cased well bore.

8. An arrangement for orienting and anchoring a whipstock in a well tubular member by manipulating a work string, said arrangement comprising:

a whipstock;

a mandrel depending from said whipstock;

means for releasably connecting said whipstock with the work string;

a packer assembly including a mechanical weight set packer supported on said mandrel; and releasable latch means to releasably secure said mandrel, whipstock and packer assembly against relative longitudinal movement.

9. The arrangement of claim 8 including upper and lower slip and cone means above and below, respectively, said packer and preventive means to prevent premature expansion of said packer by said upper and/or lower slip and cone means, said preventive means including cooperating groove means on said whipstock and upper cone means with interfitting split ring means to prevent downward movement of said upper cone means while positioning and orienting said whipstock in the well tubular member.

10. The arrangement of claim 9 wherein said packer assembly includes an expansion joint depending therefrom which is operable by manipulation of the work string to release said latch means for orienting the whipstock and setting the packer.

11. The arrangement of claim 9 wherein said preventive means to prevent premature expansion of said packer by said lower slip and cone means includes:

slot means in each said whipstock and lower cone means; and a key extending between said slot means to secure said whipstock and lower cone means against relative longitudinal movement while said releasable latch means connects said whipstock and packer against relative longitudinal movement.

12. The arrangement of claim 8 including means to inhibit relative rotation between said lower slip and cone means and means to inhibit relative rotation between said lower cone means and said whipstock.

13. The apparatus of claim 8 including co-engageable locking means on said whipstock and lower slip means to secure said whipstock and said packer in oriented and anchored position in the well tubular member.

14. Apparatus for setting a whipstock and for changing the direction of drilling through a cased well bore with a single trip of a work string by manipulating the work string, said apparatus comprising:

a whipstock;

a mill connected on the work string;

means releasably connecting said mill with said whipstock;

a mandrel secured to said whipstock and depending therefrom;

said mandrel having an annular, downwardly facing shoulder thereon;

a packer assembly supported on said mandrel, said packer assembly including:

a mechanical weight set packer surrounding said mandrel and spaced longitudinally below said shoulder on said mandrel;

said packer having upper and lower ends thereon;

an upper cone adjacent said upper end of said packer, said upper cone having an upwardly and inwardly extending annular, inclined surface thereon;

slips adjacent said inclined surface;

shear means releasably securing said slips on said inclined surface;

a lower cone adjacent said lower end of said packer, said lower cone having circumferentially spaced, longitudinally extending recesses with downwardly and inwardly extending surfaces thereon; slip means in said recesses;

a slip support member surrounding said mandrel and engaging said slip means in said recesses;

a friction cage supported by and telescopically movable relative to said slip support member;

means on said friction cage for frictionally engaging the well tubular member; and means to prevent premature setting of said packer by said upper and/or lower slip and cone means while positioning and orienting said whipstock in the well tubular member.

15. The apparatus of claim 14 wherein said means to prevent premature setting of said packer includes releasable latch means to releasably secure said whipstock and packer against relative longitudinal movement while single tripping the apparatus in the cased well bore.

16. The apparatus of claim 14 wherein said means to prevent premature expansion of said packer by said upper slip and cone means includes cooperating groove means on said mandrel and upper cone means with interfitting means to prevent downward movement of said upper cone means relative to said upper slip means.

17. The apparatus of claim 16 wherein said groove means and interfitting means are constructed and arranged to accommodate downward movement of said mandrel relative to said upper cone and slip means to set said packer in the cased well bore.

18. The apparatus of claim 17 wherein said cooperating groove means and interfitting means comprises:

annular groove means on said mandrel, said annular groove means having an annular bottom surface, a lower end surface extending laterally outwardly from the annular bottom surface towards said upper cone means and an upper end surface inclined upwardly and outwardly from the annular bottom surface;

first annular groove means on said upper cone means having an annular bottom surface, an open lower end and an upper end surface extending laterally and outwardly from the annular bottom surface toward said mandrel;

second annular groove means on said upper cone means having a larger diameter than said first annular groove means, an annular bottom surface with an upper open end joining with the annular lower open end of said first annular groove means and a bottom end surface extending laterally from said annular bottom surface outwardly toward said mandrel;

and wherein said interfitting means is a split ring positioned within said annular groove means on said mandrel and within said first annular groove means on said upper cone means;

said interfitting split ring means having an upper end surface which includes an upper inclined surface portion to conform with the upwardly and outwardly inclined surface on the upper end of said annular groove means on said mandrel and a laterally extending surface portion to conform with the laterally extending upper end surface of said first annular groove means in said upper cone means; and said interfitting split ring means having a laterally extending lower end surface to abut the bottom surface of said annular groove means on said mandrel to thereby prevent downward movement of said upper cone means relative to said upper slip means while single tripping the apparatus in the cased well bore, said interfitting split ring means movable downwardly to expand into said second annular groove means on said cone means when said mandrel is moved downwardly to accommodate lowering movement of said mandrel to actuate the mechanical weight set packer.

19. The apparatus of claim 14 including lock means to lock said mandrel to said packer assembly after said mandrel has been lowered to compress and set said packer in the cased well bore by said upper and lower slip and cone means and thereby secure said whipstock in oriented and anchored position in the cased well bore.

20. The apparatus of claim 19 wherein said lock means comprises co-engageable surface means on said mandrel and said packer assembly, said surface means engageable upon relative longitudinal movement between said mandrel and said packer assembly.

21. The apparatus of claim 15 wherein said means to prevent premature expansion of said packer by said lower slip and cone means further includes:

slot means in each said mandrel and lower cone means; and a key extending between said slot means to secure said mandrel and lower cone means against relative longitudinal movement.

22. The apparatus of claim 14 including means to inhibit relative rotation between said lower slip and cone means and means to inhibit relative rotation between said lower cone means and said mandrel.

23. Apparatus for setting a whipstock and for changing the direction of drilling through a cased well bore with a single trip of a work string and by manipulating the work string, said apparatus comprising:

a whipstock;

a mill connected on the work string;

means for releasably connecting said mill with said whipstock;

a weight compression set packer on said whipstock;

upper and lower slip and cone means on said whipstock above and below said packer; and releasable means to secure said whipstock to said packer to inhibit relative longitudinal movement therebetween as the apparatus is lowered into the cased well bore.

24. Apparatus for orienting and anchoring a whipstock assembly and for changing the direction of drilling through a cased well bore with a single trip of a work string and by manipulating the work string, said apparatus comprising:

a mill connected on the work string;

a whipstock assembly, said assembly including:

a whipstock for releasably connecting with the mill;

a mandrel secured to said whipstock and depending therefrom;

a packer assembly supported on said mandrel;

said packer assembly including a mechanical weight compression set packer; and upper and lower slip and cone means above and below, respectively, said packer.

25. The apparatus of claim 24 including releasable latch means on said mandrel and said packer assembly connecting said mandrel with said packer assembly; and restraining means to restrain said releasable latch means on said packer assembly against rotation upon rotation of said mandrel to release said mandrel from said packer assembly for longitudinal movement relative to said packer assembly.

26. A method of orienting and anchoring a whipstock and for changing the direction of drilling through a cased well bore with a single trip of a work string, wherein the whipstock is releasably connected to a mill supported on the work string, and wherein the whipstock supports a packer and slip and cone means to set the packer in the cased well bore comprising the steps of:

lowering into the cased well bore the work string with the mill thereon releasably connected to the whipstock;

rotating the work string to release the work string for longitudinal movement relative to the packer;

rotating the work string to orient the whipstock in position in the cased well bore; and moving the work string longitudinally to engage the slip and cone means with the packer to anchor the whipstock in the oriented position in the cased well bore.

27. The method of claim 26 wherein the longitudinal movement of the work string is downward relative to the packer.

28. A method of assembling an arrangement for orienting and anchoring a whipstock in a cased well bore and for changing the direction of drilling through the cased well bore in a single trip and by manipulating a work string with a mill thereon releasably connected to the whipstock, a packer assembly on the whipstock including a packer and upper and lower slip and cone means above and below, respectively, the packer with a movable friction cage telescopically connected with the packer assembly, comprising the steps of:

securing the mill to the work string;

releasably securing the mill to the whipstock;

securing the packer and the upper and lower slip and cone means on the whipstock;

telescopically connecting the friction cage to the packer assembly; and releasably connecting the whipstock to the friction cage to secure the whipstock and packer assembly against relative longitudinal movement while single tripping the apparatus in the cased well bore.

29. A method of positioning a whipstock having a mandrel with a packer thereon in a cased well bore and anchoring the whipstock in position with the packer by manipulating a work string in the cased well bore, comprising the steps of:

lowering the work string with the whipstock and the packer on the mandrel into the cased well bore;

manipulating the work string to release the mandrel for relative longitudinal movement between the mandrel and the packer;

manipulating the work string to orient the whipstock in the cased well bore; and lowering the mandrel to anchor the packer and secure the whipstock in oriented position.

30. The method of claim 29, including the step of initially securing a mill on the work string and releasably securing the whipstock to the mill.

* * * * *